United States Patent [19]

Allen

[11] 4,328,735

[45] May 11, 1982

[54] PROGRESSIVE SHOTSHELL RELOADING

[76] Inventor: Johnnie D. Allen, 105 Bayou Vista Dr., Hitchcock, Tex. 77563

[21] Appl. No.: 8,169

[22] Filed: Jan. 31, 1979

[51] Int. Cl.[3] ..... F42B 33/00

[52] U.S. Cl. ..... 86/36; 86/23; 86/26; 86/27; 86/29; 86/45

[58] Field of Search ..... 86/23, 26, 27, 29, 36, 86/45

[56] References Cited

U.S. PATENT DOCUMENTS

| | | | |
|---|---|---|---|
| 2,663,421 | 12/1953 | Reynolds et al. | 86/25 X |
| 3,259,007 | 7/1966 | Havourd et al. | 86/36 |
| 3,973,465 | 8/1976 | Bachhuber et al. | 86/36 |
| 4,031,804 | 6/1977 | Boschi | 86/27 X |

*Primary Examiner*—Benjamin R. Padgett
*Assistant Examiner*—Irwin Gluck

[57] ABSTRACT

This invention relates to some unique mechanical devices, which, when attached in natural sequence to a shotshell reloading press, allows faster, smoother and more compatable performance of said press.

Specific devices which are included are, (1) a device designed for more positive reciprocation of a carrying ram, which, when actuated, meters and carries, "either wads of primers to their destination for instillation in a spent shotshell casing". (2) Another unique mechanical device is a miniature leverage system which feeds empty shell casings into the holding slots of the index carrier plate by means of a coordinated swivel mounted lever which forces said casings into holding slots of said carrier index plate upon the acuation of said press. (3) To conclude the unique devices of this application is a holding tray for new primers. Said tray is provided to be attached above said ram wherein new primers are electro-mechanically viberated from holding tray, down a length of tubing and into a cavity of said ram where said primers are reciprocated to their destination of instillation.

4 Claims, 4 Drawing Figures

PROGRESSIVE SHOTSHELL RELOADING

BACKGROUND OF INVENTION

There have been many hand operated semi-automatic shotshell reloading tools introduced to the market in recent years. Most are or have been adequately suited for what their designer strived to achieve. Naturally some are faster than others, mostly because some are more sophisticated than others but to my knowledge, no one has ever before successfully designed and marketed a said tool being provided of enough or the right design of automatic feeding devices to allow continuous operation of said tool without some sort of built in interruption within each reloading cycle of said reloading tool.

The following description described herein teaches the use of several automatic component feeding devices which will allow the continuous operation of said tool without any interruptions from component feeding.

DETAILED DESCRIPTION OF INVENTION

It is obvious to anyone ordinarily skilled in the art of reloading shotshells that a progressive and or a semi-automatic shotshell reloading tool is a press consisting of one or two struts, having two platens for holding dies which mate to form the various reloading operations. One platen of which is permanently attached to said strut or struts while the other is slidably fitted, allowing forced reciprocal action by the actuation of a lever provided therein. Said strut or struts are adequately supported by a base of which is facilitated to be rigidly attached to a work bench or table.

Because of the obvious nature described above there are no drawings of a said loading tool, nor will there be any reference to a specific type of said tool.

In designing a new and faster said tool I found that the accepted methods of achieving reciprocal action to the bars and rams of such devices as automatic primer feeders, automatic wad feeders and automatic shot and powder feeders are inadequate for my type of design.

Figure 1:
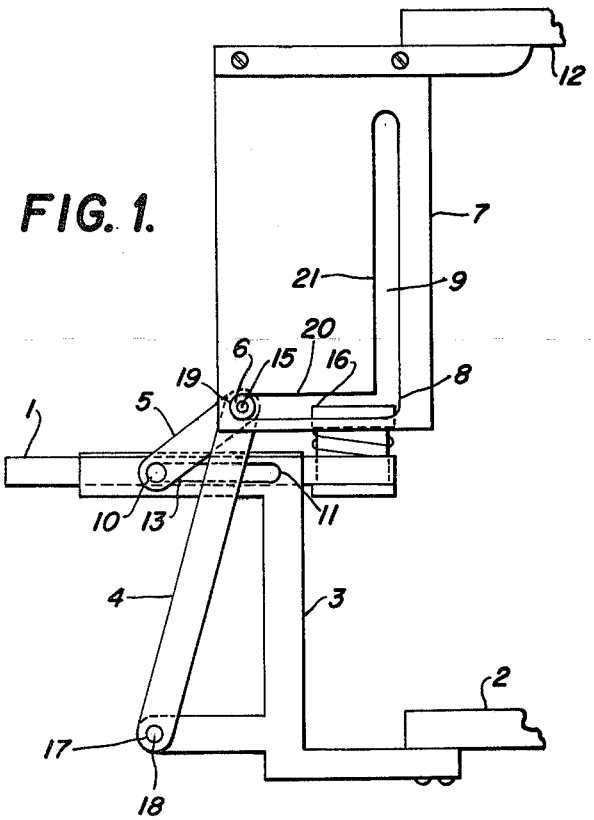
FIG. 1 A side view of a mechanical device whose method of achieving reciprocal movement of a ram or bar which may be modified to suit the automatic feeding of all loading components used in the reloading of shotshells.

In FIG. 1 is illustrated a unique device and method which achieves the reciprocal action suited for my design of said tool. I have used three different versions of this method which proves its versatility. They include, the automatic feeding of primers, the automatic feeding of wads and the automatic actuation of the powder and shot metering bar.

It will be noted that there is a frame 3 which is facilitated to be attached to a platen 2 of a base 14 and supporting a long linkage 4 and a shorter linkage 5. Linkage 4 and 5 are so attached at point 15 allowing swiver movement while providing a roller 6 to traverse within slot 9 and along outer surfaces 20 and 21 of said slot.

The other end 17 of linkage 4 is swivelably attached 18 to frame 3 while the other end of linkage 5 is swivelably attached to ram 1 at point 10. It will be noted that from point 10 to point 11 there is a slot 13 provided of frame 3 wherein slidable movement of ram 1 is allowed but restricted.

Further it will be noted that mounted above and in cooperation of said device is linkage 4, 5 and roller 6 is a slotted template 7 which when lowered or when frame 3 is raised forces roller 6 horizontally to right and finally upward in slot 9. It is of natural consequence that when this action is reversed, roller 6 is returned to point 19 thus achieving reciprocal movement.

As illustrated in FIG. 1, template 7 is provided with a connecting vertical slot which prevents over-riding of roller 6 while completing the reloading cycle.

It will be noted herein that part 16 of FIG. 1 is shown as a telescoping, spring loaded wad receptacle. It can easily be modified to accept primers or other components for transferring from one point to another.

There are so many ways that this device can be modified to suit the application that it would be impossible to explain them all. For one thing, the template 7 does not have to be slotted for roller 6. It can be just a rectangular or square section of metal wherein the roller 6 is forced to travel along bottom and side edges and using a spring to return said ram 1 or bar to its relaxed position. Linkages 4 and 5 may be shortened or lengthened to either speed up or slow down the speed of the reciprocating ram 1 or bar. Pivot points may be changed to suit the particular application. Literally nothing remains constant and a mathematical formula to determine a specific application would be almost impossible.

Figure 2:
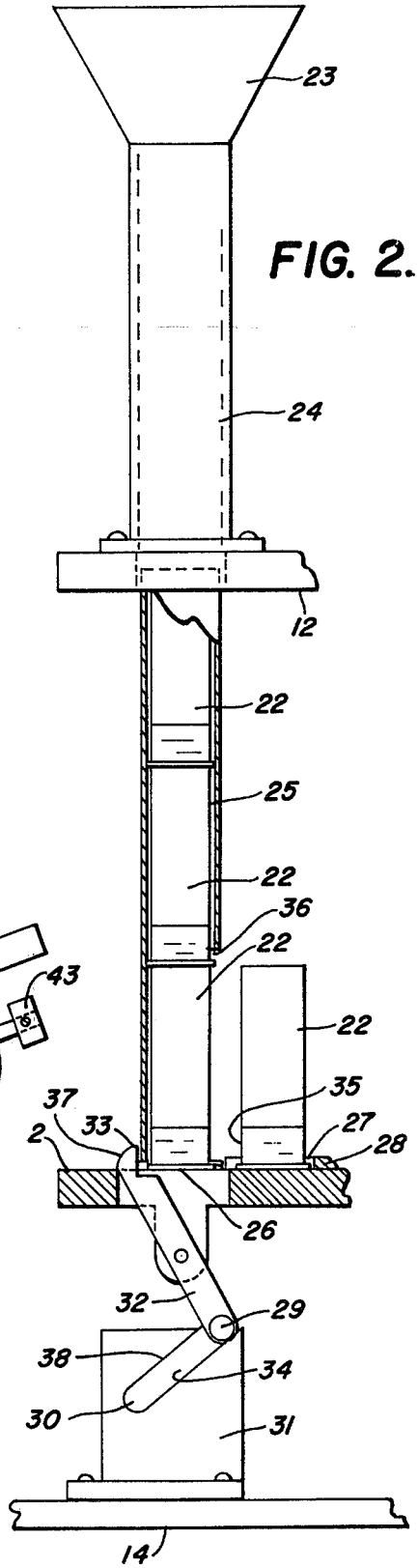
FIG. 2 A part sectional and side view of the mechanism used to automatically feed shell casings into slot of rotating index plate of reloading tool.

In FIG. 2 is illustrated a unique device which I have perfected to automatically feed shell casings into the rotating index plate of said reloading tool. As pictured, shell casings are dropped into a funnel 23 of upper feeder tube 24 where they feed by gravity through upper feeder tube 24 and lower feeder tube 25 and finally to point 26 where said casings 22 will be kicked into the awaiting slot 27 of said index plate 28 at the end of each cycle of said reloading tool.

Point 2 is the lower and movable platen of the loading tool, while point 12 is the upper and rigid platen. As the cycle of said tool starts the actuating roller 29 to pivot bar 32 is at point 30 of slot 34 of template 31. As of natural consequence point 33 of pivot bar 32 is at point 35 of shell casing 22 where a new shell casing 22 has been moved from feeder tube 25 through port 36 and into index plate 28 slot 27. At this point there will be a shell casing 22 resting on top 37 of pivot bar 32. As the lower platen moves upward, roller 29 is forced along upper edge 38 of angled slot 34 of template 31 and consequently moving point 33 of pivot bar 32 to the position pictured, wherein a new casing 22 is dropped to point 26 awaiting the same action as described above. As pictured, the lower feeder tube 25 is telescoped inside upper feeder tube 24 during the raising and the lowering of platen 2 in completing the reloading sequence.

Figure 3:
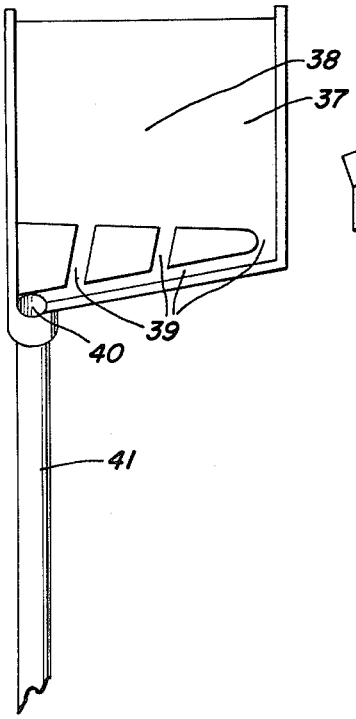
FIG. 3 A top elevation of the primer loading platen.

In FIG. 3 is pictured a shallow box which is the primer loading platen 37. Here new primers are loaded into platen 37 around area 38 by inserting a box of primers upside down, removing the cover and lifting the box upward. From this point the primers are vibrated through the passages 39 which are raised sections of the platen 37 floor forming such passages (slightly angled)

Figure 4:
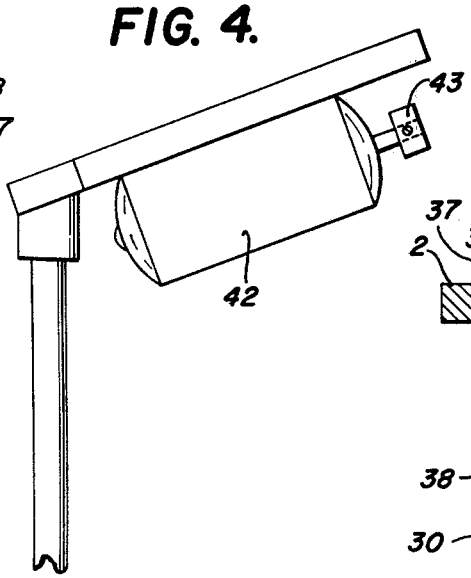
FIG. 4 A side view of the primer loading platen while having a small, high speed counterweighted electric motor attached underneath which is used to vibrate primers from platen into the primer feed tube.

39 where said primers ultimately fall into the open end 40 of primer feed tube where said primers will eventually fall into a provided cavity of ram 1 and carried to a primer seating device (not pictured). As illustrated in FIG. 4, a small high speed electric motor 42 which is provided with a counterweight 43 for the purpose of creating the necessary vibrating action required to move said primers into feeder tube 41.

It will be noted herein that for the purpose of vibrating said platen a regular vibrator motor may also be used.

What I claim is:

1. An automatic primer carrying device facilitated of a mountable frame encasing a slidable ram, said ram being capable of accepting primers from a feeder tube into a provided cavity of said ram while carrying said primers to a primer seating device;

said slidable ram being mechanically actuated through a slot provided of said frame by a swivel connected end of a short linkage whose other end of said linkage is swivelably connected to a longer linkage where a roller is provided;

other end of said linkage is also swivelably connected to a lower part of said frame while anchoring linkages;

a slotted template being mounted to a movable platen of said loading tool and in cooperation with said roller wherein said ram is forced into reciprocal movement when said template is moved up and down with the reloading cycle.

2. An automatic wad carrying device facilitated of a mountable frame encasing a slidable ram, said ram being provided with a wad guiding cylinder while also serving as a hopper to accept wads from the hand;

said ram being actuated through a slot of said frame by a short linkage being swivelably connected at one end while the other end of said linkage is also swivelably connected to a longer linkage wherein a roller is provided, other end of said longer linkage is swivelably connected to a lower part of said frame and anchoring linkages, a rectangular template being mounted to upper platen of said loading tool is in cooperation with said roller of which forces said roller forward and down with the actuation of said reloading tool thus accomplishing the first half of the required reciprocal movement while the second half is achieved when the reloading tool is returned to normal position and a provided spring pulls said movable ram back to normal position.

3. An automatic shell carrying device, which when actuated feeds a shell casing into the slot of the rotating index plate, said device consisting of a secondary telescoping feed tube wherein is received empty shell casings awaiting to be pushed into the receiver slot of index plate by a pivot bar of which is swivelably mounted to lower platen inline and under feed tube, said pivot bar being provided with a roller of which is in cooperation with an angular slotted template of which is mounted to base, said template at the end of each reloading cycle forces rollers from right side to left side while actuating said pivot bar toward slot of index plate wherein a shell casing is pushed into said slot.

4. An automatic primer seating device which is facilitated with an angular mounted primer retaining box having portions of its floor raised to form a partial block and angled passages which allow primers to feed into primer feed tube without jamming, a said retaining box being comprised of an under mounted electric vibrating motor which shakes said primers from said retaining box into primer feed tube which connects with said automatic primer seating device.

* * * * *